United States Patent [19]

Kitazawa

[11] Patent Number: 5,022,239

[45] Date of Patent: Jun. 11, 1991

[54] YARN EXCHANGE DEVICE FOR A FLAT-BED KNITTING MACHINE

[75] Inventor: Hiroshi Kitazawa, Nagoya, Japan

[73] Assignee: Brother Kogyo Kabushiki Kaisha, Aichi, Japan

[21] Appl. No.: 530,806

[22] Filed: May 30, 1990

[30] Foreign Application Priority Data

May 30, 1989 [JP] Japan ..... 1-138576

[51] Int. Cl.[5] ..... D04B 15/52

[52] U.S. Cl. ..... 66/127

[58] Field of Search ..... 66/126 R, 127, 128

[56] References Cited

U.S. PATENT DOCUMENTS 3,911,700 10/1975 Tschumperlin ..... 66/127
4,111,007 9/1978 Yokoyama ..... 66/127 X
4,354,363 10/1982 Inoue ..... 66/128

FOREIGN PATENT DOCUMENTS 2112628 8/1972 Fed. Rep. of Germany .

*Primary Examiner*—Wm. Carter Reynolds
*Attorney, Agent, or Firm*—Oliff & Berridge

[57] ABSTRACT

A flat bed knitting machine with at least one carriage mounted to a needle bed. A yarn changing device is capable of picking yarn guide collars from collar support racks located at both ends of the needle bed. Each collar rack is designed to hold a plurality of yarn guide collars. The yarn changing device includes a collar support mechanism carried by the carriage for detachably holding a selected one of the collars. The collar support mechanism has three working positions including an operational position and two transfer positions. Each transfer position allows the transfer of the selected collar between the collar support mechanism and one of the support racks. A mechanism is also provided to change the position of the collar support in response to movements of the carriage relative to the needle bed. In a preferred embodiment, the position changing mechanism changes the position of the collar support mechanism in response to movements of the carriage relative to the needle bed.

6 Claims, 14 Drawing Sheets

YARN EXCHANGE DEVICE FOR A FLAT-BED KNITTING MACHINE

BACKGROUND OF THE INVENTION

The present invention relates generally to yarn changing devices for flat bed knitting machines. More particularly, yarn guide collar support racks are provided on opposite ends of the knitting bed to hold yarn to be knitted. The yarn changing device is adapted to pick yarn guide collars held at either end of the knitting machine.

Flat bed knitting machines are generally well known. For example, U.S. Pat. No. 3,911,700 discloses a knitting machine having a storage rack on one side of the knitting machine. A plurality of yarn guide collars are detachably held within the storage rack. A carriage is provided on the main body of the knitting machine. The carriage is arranged to move back and forth along a needle bed and has a yarn changing device thereon. The yarn changing device is capable of picking collars from the storage rack at one end of the needle bed and includes a collar support member arranged to hold a selected collar. In order to change yarns during the knitting operation, the carriage moves to the end of the needle bed adjacent the collar supporting device. The particular collar holding the desired yarn is then exchanged for the collar currently held by the carriage. In this manner, patterns having multiple colors can be knitted by changing the yarns used during the knitting operation. Although such devices are capable of knitting fabric having multiple colors, they have certain undesirable limitations. For example, since the collar supporting device is located at only one end of the needle bed, every time a yarn change is desired, the carriage must travel to the yarn changing end of the needle bed.

U.S. Pat. No. 4,111,007 discloses a yarn changing device for flat-bed knitting machines having an alternative construction. However, like the previously described patent, it contemplates changing the active yarns at only one end of the needle bed. U.S. Pat. No. 4,354,363 discloses a controller for directing the movements of a carriage along the needle bed of a flat bed knitting machine.

SUMMARY OF THE INVENTION

Accordingly, it is an objective of the present invention to provide a flat bed knitting machine having collar support racks on both sides of the needle bed.

Another object of the invention is to provide a simple and efficient mechanism for exchanging a multiplicity of yarns during the knitting operation.

To achieve the foregoing and other objects and in accordance with the purpose of the present invention, a flat bed knitting machine is provided having a longitudinally elongated needle bed that has a knitting section therein. A carriage is slidably mounted on the needle bed for longitudinal movement relative to the needle bed. The machine is adapted to pick a selected collar from collar support racks provided on opposite sides of the knitting section. Each collar rack is designed to hold a plurality of yarn guide collars. The yarn guide collars are each adapted to hold a yarn. A collar support mechanism is carried by the carriage for detachably holding a selected one of the collars. The collar support mechanism has two transfer positions with each transfer positions allowing the transfer of the selected collar between the collar support mechanism and one of the support racks. A mechanism is also provided to change the position of the collar support mechanism in response to movements of the carriage relative to the needle bed.

Preferably the collar support mechanism also has an operational position distinct from the transfer positions, which is assumed during the knitting operation. In a preferred embodiment, the position changing mechanism changes the position of the collar support mechanism in response to movements of the carriage relative to the needle bed.

In a further preferred embodiment, the position changing mechanism includes a control plate slidably mounted on the carriage for movement relative thereto within a limited range. The control plate interlocks with the carriage when the carriage is within the knitting section and moves relative to the carriage in the regions between the knitting section and the collar support racks.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiments together with the accompanying drawings in which:

FIG. 1(*b*) is a front elevational view of the carriage connecting device shown in FIG. 1(*a*).

FIG. 2(*b*) is a front elevational view of the carriage connecting device shown in FIG. 2(*a*).

DETAILED DESCRIPTION OF THE PREFERRED EMBODIMENTS

Figure 1:
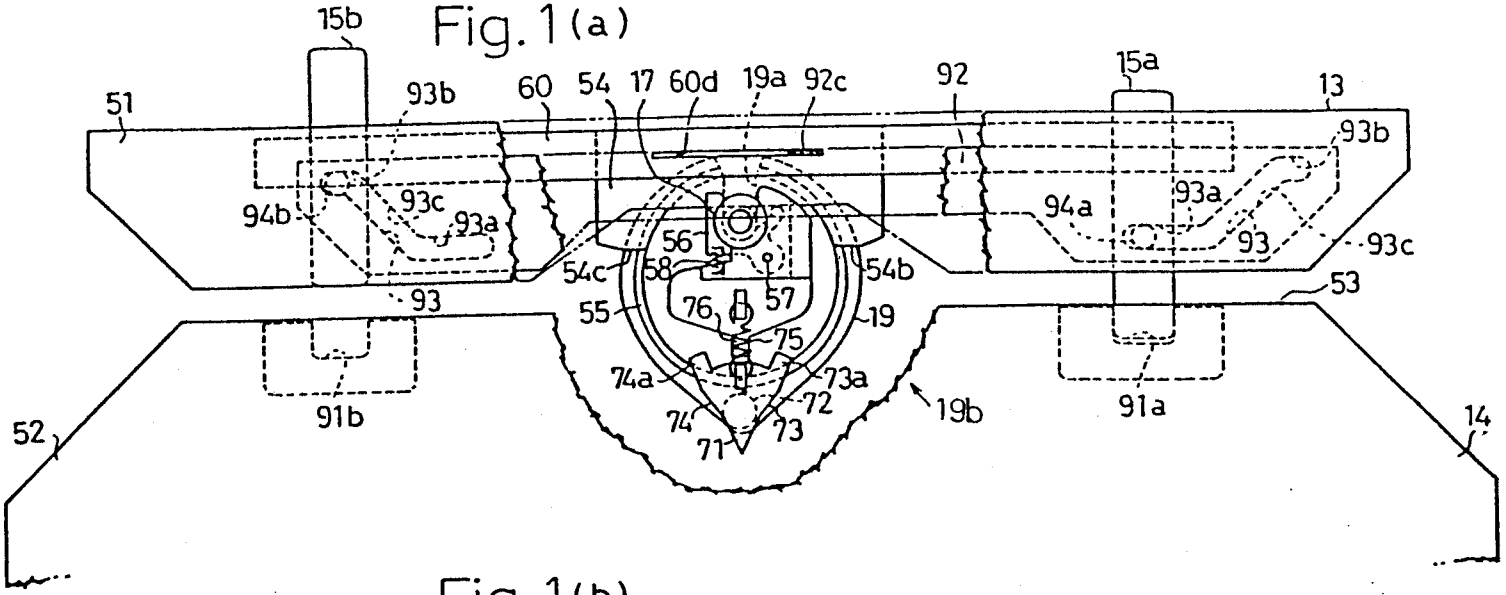
FIG. 1(*a*) is a top plan view of a carriage connecting device designed in accordance with the present invention, wherein the collar support member is oriented in the operational position for knitting.
Figure 1:
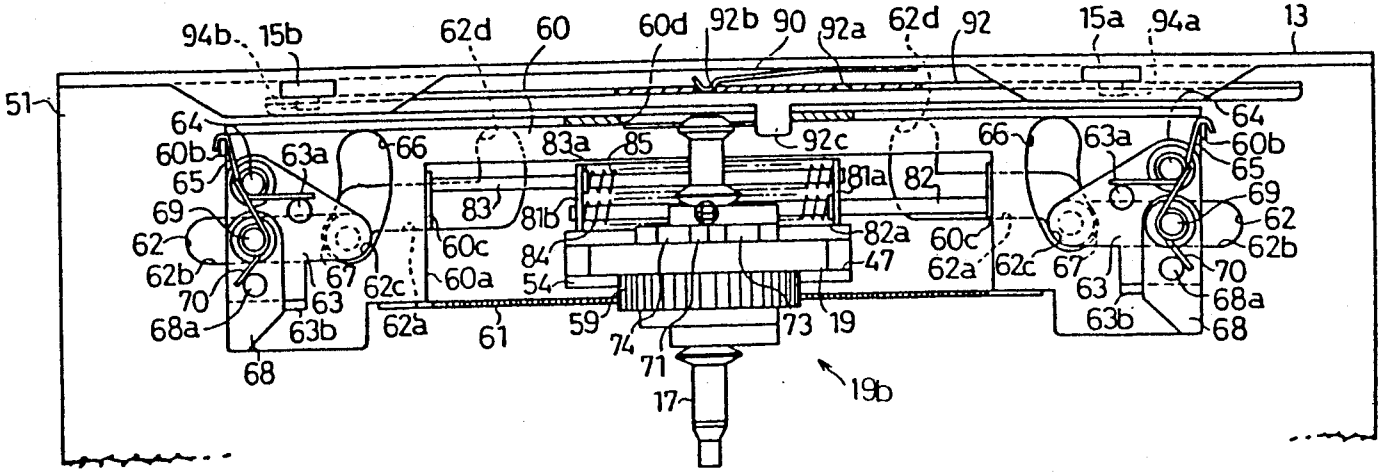

As illustrated in the drawings, a preferred embodiment of the flat bed knitting machine of the present invention includes a pair of adjacent elongated needle beds 11 and 12 that constitute a so-called V-bed knitting machine. Typically, the second needle bed is fastened to the first needle bed in a manner such that it may be readily detached so that the knitting machine 10 may be operated as a single bed machine if desired to produce the particular pattern being knitted. Each needle bed 11, 12, has a multiplicity of corresponding movable latch needles 11*a*, 12*a* and fixed sinkers 11*b*, 12*b* of conventional design. The needles are arranged in needle arrays 11*c* and 12*c* centered along the length of their respective beds. A first carriage 13 is arranged to travel back and forth along the first needle bed 11. Similarly, a second carriage 14 travels back and forth along the second needle bed 12.

Figure 3:
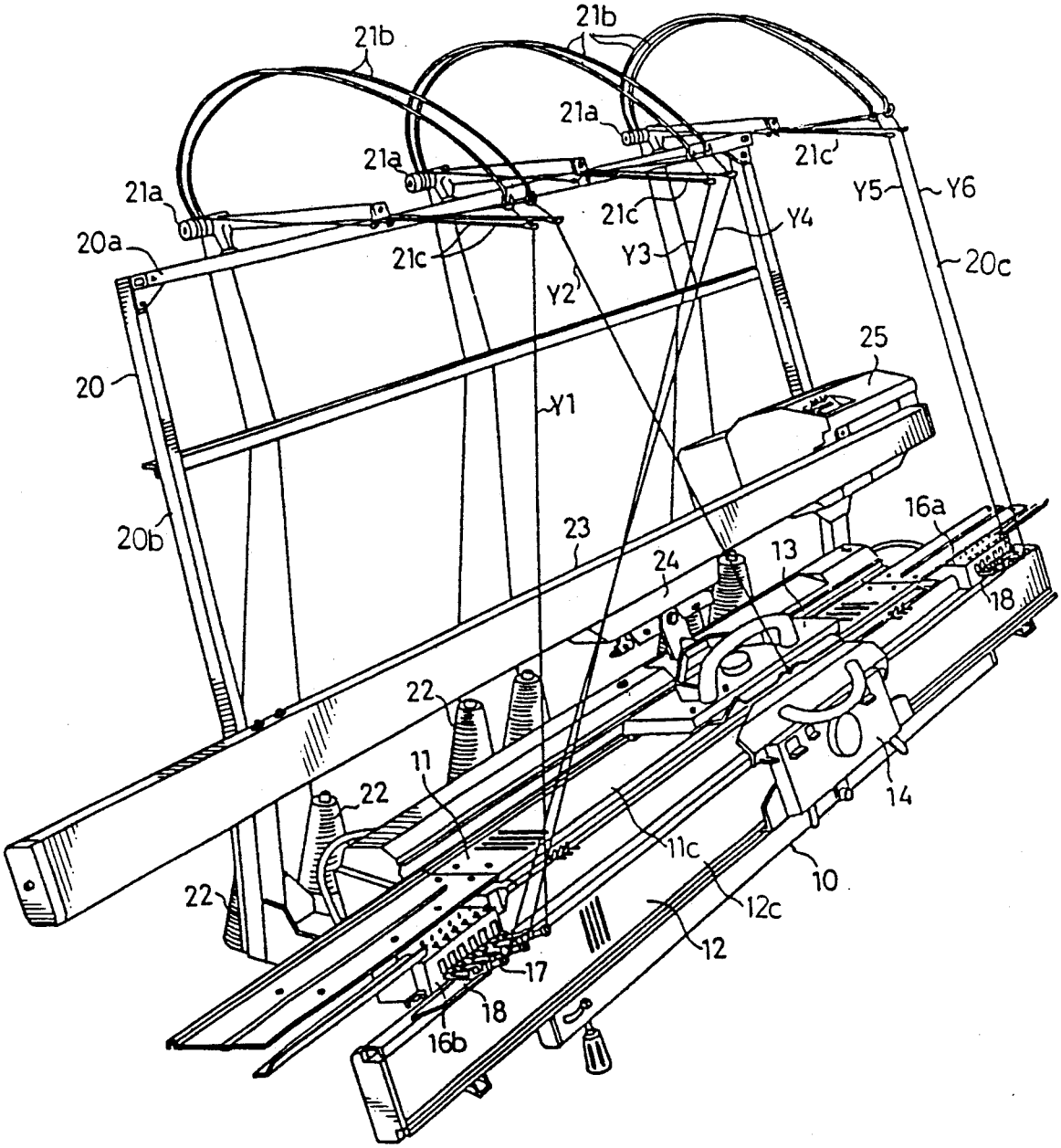
FIG. 3 is a perspective view of a knitting machine built in accordance with the present invention.

An elongated belt guide bar 23 is mounted to a frame 20 above the first needle bed 11. An endless belt (not shown) is disposed within the belt guide bar 23. A linkage bar 24 couples the endless belt to the first carriage 13. Thus, as best seen in FIG. 3, the carriages 13 and 14 can be moved back and forth along the first needle bed 11 by driving the endless belt in opposite directions within guide bar 23. A control box 25 is mounted to the elongated belt guide bar and houses a reversible motor (not shown) and the transmission mechanisms (not shown) required to drive the endless belt. A controller (not shown) is then provided control the movements of the endless belt, which in turn, controls the movements of the carriage 13 over the first needle bed 11.

Although directions are of course arbitrary, in the description below, the "right" side of the knitting machine will be considered the side shown to the right in FIGS. 1 and 3, while the "left" side will be considered the side that appears to the left of the viewer in the same figures. Thus, in the embodiment shown, the control box 25 is mounted on the right side of the belt guide bar 23.

Figure 10:
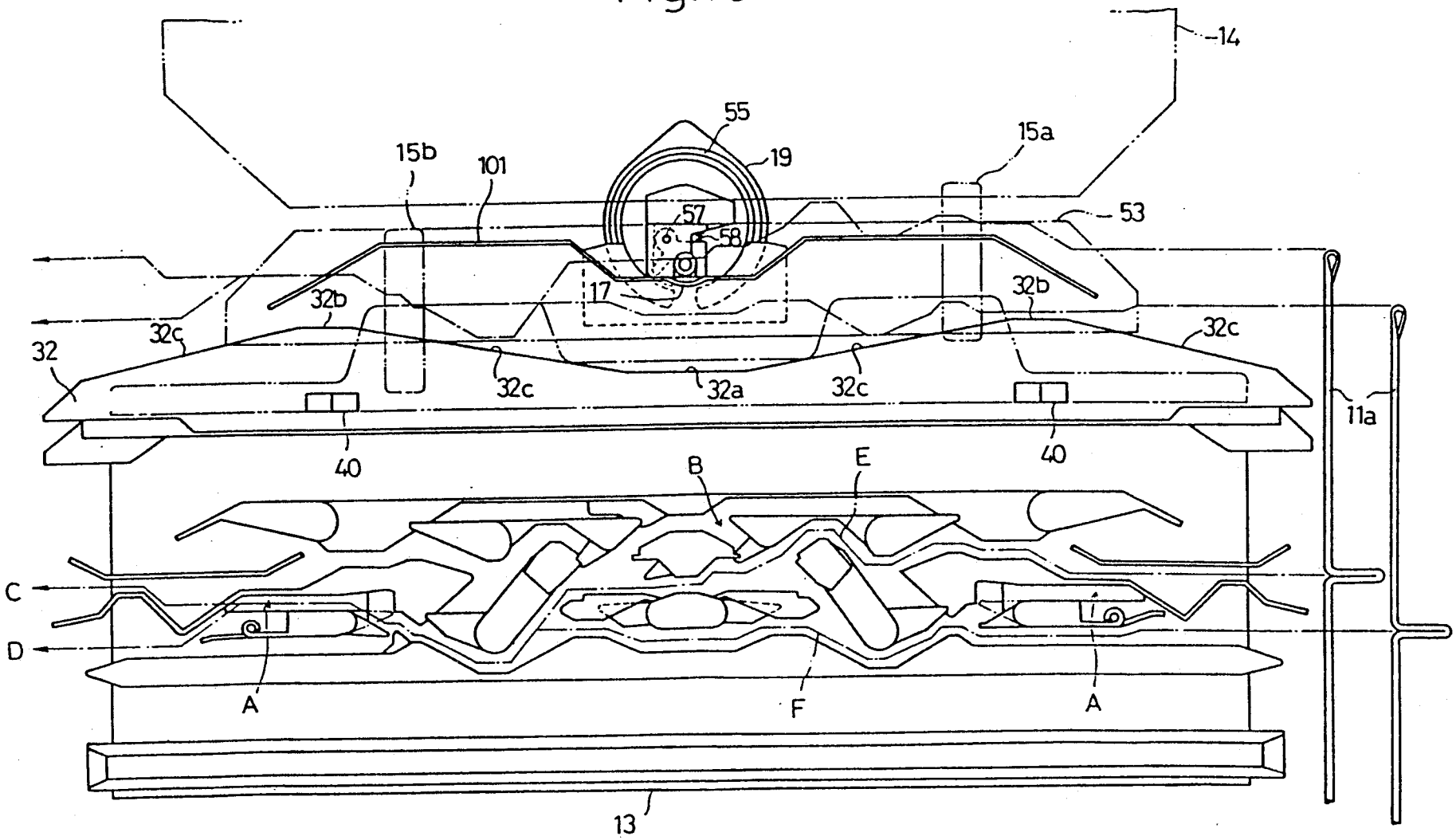
FIG. 10 is a diagrammatic bottom view of the carriage shown in FIG. 8 in the operational position adjacent the needle selecting device.

Referring specifically to FIG. 10, a conventional needle selection device is provided for choosing the desired needles from the needle beds. The needle selection device includes a selector A, knitting passage E, non-knitting passage F, a multiplicity of cams B as well as knitting and non-knitting introduction passages C and D.

The needles are first laid on the needle bed in either a knitting or a non-knitting position, which are staggered relative to one another. Each needle is picked up by the appropriate introduction passage. The needles in the non-knitting position pass through non-knitting passage F to the needle selector A which directs them towards either the knitting or non-knitting introduction passages C and D which lay the needles in the appropriate position for the next pass in the knitting operation. The needles resting in the knitting position pass through the knitting passage E and their passage through cams B directs the knitting actions of the needles. Once the desired knitting actions have been accomplished, these needles also pass by needle selector A which sends them to the appropriate introduction passage to be laid for the carriages next pass.

Figure 4:
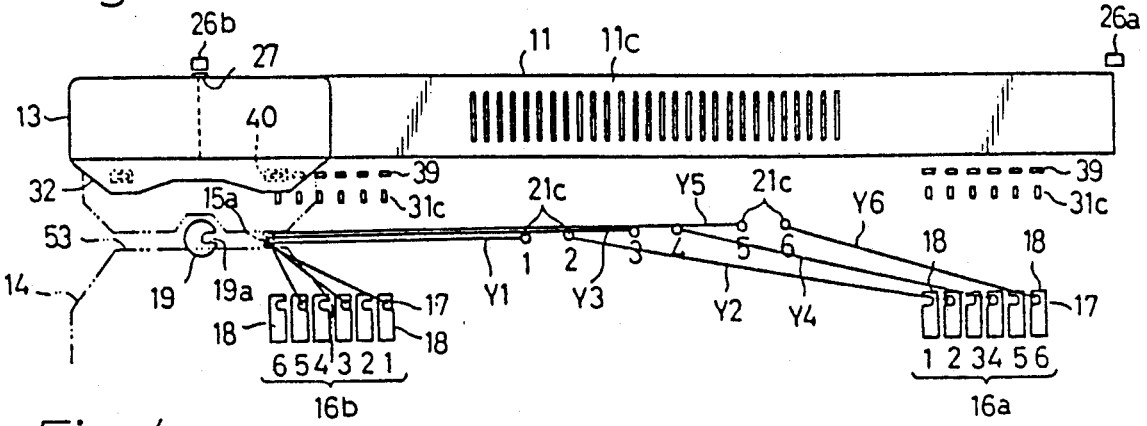
FIGS. 4(*a*)–4(*j*) are sequential schematic drawings of the first needle bed, carriages and collar support racks showing the transfer of yarns between the opposite racks and the yarn changing device.
Figure 4:
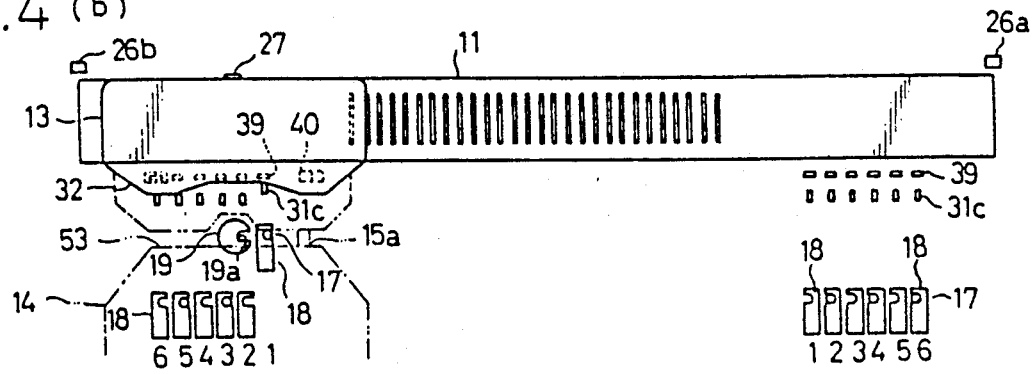
Figure 4:
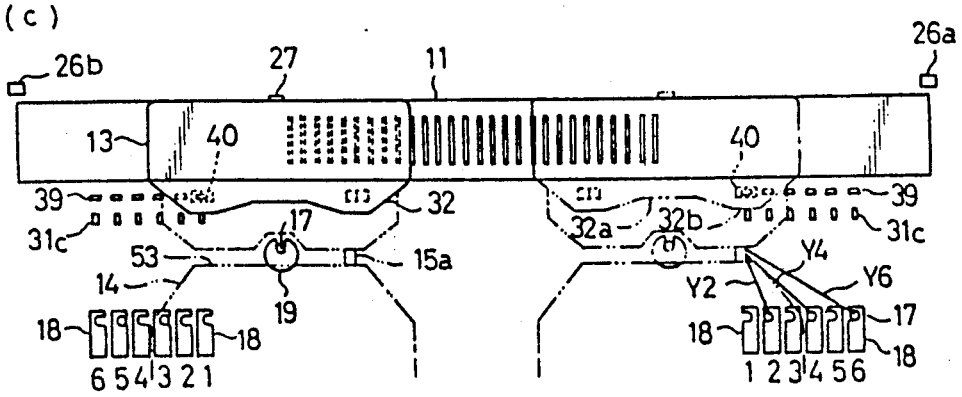
Figure 4D:
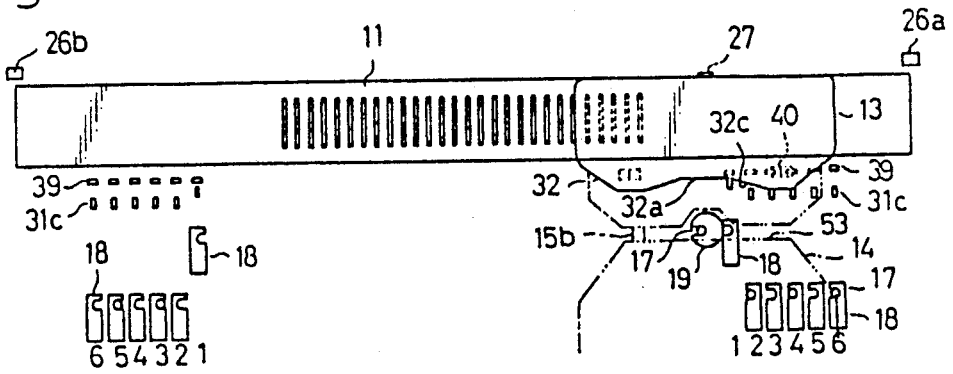

Carriages 13 and 14 are coupled by a pair of retractable connecting members 15. As seen in FIGS. 4(*a*)-(*j*) and as will be more fully described below, only one of the connecting members engages the carriage at a time during normal opertions. Thus, when connecting member 15*a* is extended into engagement with the opposing carriage, connecting member 15*b* is withdrawn and vice versa.

A pair of position sensors 26 are provided adjacent opposite ends of the first needle bed 11 outside of the knitting needle array section 11*c*. The position sensors 26 are electronically coupled to the controller and are used to mark the respective ends of the intended travel of carriages 13 and 14. Specifically, right position sensor 26*a* marks the right limit for the carriages movement while left position sensor 26*b* marks the limit of travel to the left. A magnet 27, mounted on the back surface of carriage 13 is detected by the position sensors when the carriage approaches.

Referring next to FIG. 3, a pair of collar support racks 16*a* and 16*b* are provided on opposite ends of the needle beds. The collar support racks are positioned inside of the sensors 26, but a spaced distance outside of the needle array section 11*c*. Each collar rack has a multiplicity of individually accessible collar holders 18. The collar holders 18 each have a recess that is adapted to releasably engage a collar 17. As best seen in the FIGS. 4*a*-4*j*, the recesses in the holders in opposing collar racks 16*a* and 16*b* face one another. Each of the holders 18 is movable between an active transfer position and a passive holding position. The knitting machine is arranged so that the holders 18 can communicate with a collar support member 19 on the yarn changing device 19*b* when the holders are in the active position. Although the actual number of holders provided within each collar support rack 16 will vary in accordance with the size and scale of the knitting machine, the number of holders 18 provided in each rack 16 will equal the number of yarns that the machine si capable of working with. Thus, both racks have the same number of holders 18. In the embodiment chosen for the purpose of illustration, the knitting machine is capable of handling six yarns. Thus, each rack 16 houses six collar holders 18. These holders are labeled 1-6 in the FIGS. 4*a*-4*j*.

A plurality of collars 17 are provided with each collar being adapted to hold a single yarn. The collars 17 are elongated tubular cylinders each having an axial bore extending therethrough. The yarns are passed though the axial bore of their associated collar. Again, although the actual number of yarns Y used in a particular application will vary depending upon the desired pattern, the described machine is capable of handling six different yarns Y1-Y6 and therefore, the description and drawings describe a device wherein six yarns Y1-Y6 are used. Accordingly, six yarn guide collars 17 are provided with each yarn Y1-Y6.

Figure 4E:
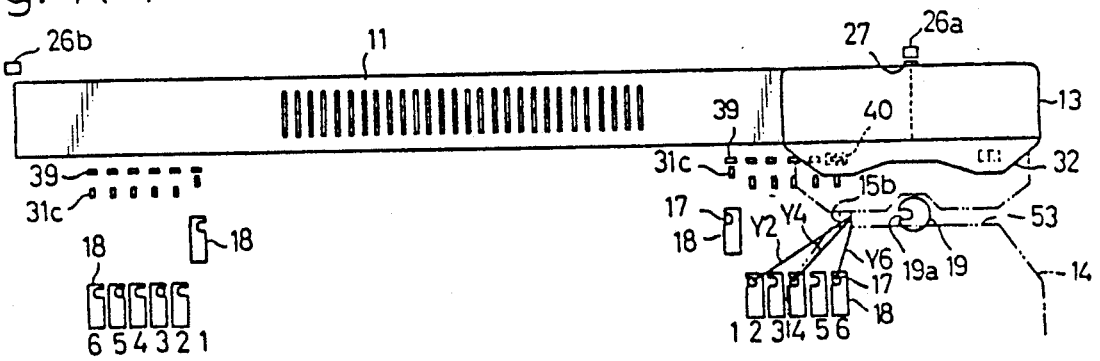

The yarn changing device 19*b* has a collar support member 19 that is adapted to cooperate with the collar holders 18 to transfer yarn between the collar racks 16 and the working portion of the knitting machine. The collar support member 19 is rotatable over a range of approximately 180 degrees. A yarn recess 19*a*, which is formed in the support member 19 is adapted to releasably engage a single collar 17. The collar support member 19 has three working positions. These include two transfer positions and an operational position. In a first transfer position as shown in FIG. 4*a*, the yarn support recess 19*a* is oriented such that it faces the right side of the knitting machine. In this position, yarn collars 17 can be effectively transferred between the left collar support rack 16*a* and the yarn changing device 19*b*. In a second transfer position, as shown in FIG. 4*e*, the yarn support recess 19*a* is oriented to face the left side of the knitting machine. In this position, transfers can occur between the yarn changing device and the right collar rack 16*a*. In the third position, the yarn support recess 19*a* faces the fabric being knitted in an operational position to provide the needles 11*a* and 12*a* with the particular yarns carried by the active yarn guide collar 17. The yarn changing device is arranged so that the collar support member only rotates in the regions between the knitting needles array and the respective racks.

Referring next to FIG. 3, the frame 20 carries a plurality of yarn tensioning devices 21*a*. Each of the yarn tensioning devices is arranged to apply tension to a pair of the yarns Y1–Y6. Each tensioning device 21*a* includes a tensioning spring 21*b* and a pair of yarn guides 21*c*. In the described embodiment, three yarn tensioning devices are provided. Thus, there are six yarn guides 21*c*, with each yarn guide handling a single one of the yarns Y1–Y6. The yarns Y1–Y6, originate at yarn supply sources 22 and are threaded through their assocaited yarn guide 21*c* and guide collar 17.

The tips of the yarn guides are staggered front to back so that the yarns do not interfere with one another regardless of their respective positions relative to the needle beds. In the illustrated embodiment, this is accomplished by offsetting the frame 20. Specifically, the frame 20 includes an upper horizontal support member 20*a* and a pair of upwardly extending support members 20*b* and 20*c*. In the embodiment chosen for the purpose of illustration, the left upwardly extending support member is bent backwards so that the left side of horizontal support member 20*a* is somewhat behind its right side. By way of example, in a machine having a carriage travel of approximately one meter, an offset of eight centimeters would be appropriate. In such an arrangement, the three yarn tensioning devices 21*a* may be equidistantly spaced, as for example, 35 centimeters apart. It should be appreciated that with such an arrangement, when the various yarns are crossed during operation and/or storage at either of the opposing collar support racks 16, the yarns held by a given yarn guide 21*c* will pass in back of yarns held by yarn guides positioned to their right, while they will pass in front of yarns held by yarn guides positioned to their left. Thus, they remain clear of entanglement during operation of the knitting machine.

Referring next to FIGS. 4*a*–4*j*, the operation of the knitting machine will be described. The yarns Y1–Y6 are initially threaded through their respective guide collars 17. The collars holding yarns Y1, Y3 and Y5 (hereinafter collars 1,3 and 5 respectively) are initially placed in their associated holders in the left collar support rack 16*b*. The collars holding yarns Y2, Y4 and Y6 (collars 2, 4 and 6) are placed in their associated holders in the right collar support rack 16*a*. The carriages 13 and 14 are coupled together by connecting member 15*a*. They are initially moved to their leftmost position slightly beyond the left support rack 16*b*. It is noted that in this state, the magnet 27 is located adjacent the left position sensor 26*b*. In this position, the collar support member 19 is oriented in the left transfer position with recess 19*a* facing to the right.

The yarns chosen at any particular stage in a knitting operation will be dependent upon the specific pattern being knitted. The yarn selection may be automatically controlled to produce the desired pattern. A suitable controller is described in Japanese application No. 1-151181. Other controllers are also generally known. In this description, it is assumed that the first yarn to be knitted is Y1.

To begin knitting, holder #1 within the left support rack 16*b* is rotated to its transfer position as seen in FIG. 4*b*. The carriages 13 and 14 are moved to the right such that the collar support member 19 picks the first collar 17 from its associated holder and proceeds towards the right side of the needle bed 11 as seen in FIG. 4*c*. Once the yarn guide collar 17 has been secured within recess 19*a* and the yarn changing device is clear of the support rack 16*b*, the collar support member 19 is rotated 90 degrees so that the recess 19*a* faces the needle bed in the operational knitting position. The rotation occurs as the carriage is moved between the left support rack 16*b* and the left side of the needle array. The carriage then proceeds to move as required to carry out the desired knitting actions. the needle selecting device thus delivers the appropriate needles 11*a* and 12*a* to the active yarn. The knitting operation may then be carried out in a conventional manner. It is noted that with the described rack arrangement, yarns Y3 and Y5 are clear of the yarn passage 53 between the carriages 13 and 14 when the knitting operation occurs. At the same time, the connecting member 15*a*, which couples the carriages together, prevents the yarns Y2, Y4 and Y6 from entering the yarn passage 53. Thus, none of the inactive yarns Y2–Y6 interfere with the knitting operation.

When the desired knitting pattern calls for a change in the yarn being used, the carriages are moved to the end of the knitting bed where the next desired yarn is located and the yarn changing device 19*b* exchanges the active yarn for the desired yarn.

In order to facilitate the description of the exchanging process, it will be assumed that the pattern to be knitted calls for the use of yarn Y6. Since yarn Y6 is currently located in the #6 holder 18 of the right support rack 16*a*, the carriages are moved towards the right end of the needle bed 11 as seen in FIG. 4*c*. In the region between the needle array and the right support rack 16*a*, the left connecting member 15*b* is extended into engagement between the carriages, while right connecting member 15*a* is withdrawn. Additionally, the collar support member 19 is rotated 90 degrees counterclockwise so that the recess 19*a* faces to the left. The collar holder #1 in right support rack 16*a* is rotated to the transfer position. And the carriages are moved further to the right to obtain the state shown in FIG. 4*d*. As the collar support member 19 passes the first holder in the support rack, the active guide collar #1 is passed to its associated holder in the right support rack 16*a*. As seen in FIG. 4*e*, the carriages then proceed to the extreme right position along their beds which is marked by the position sensor 26*a*.

Figure 4F:
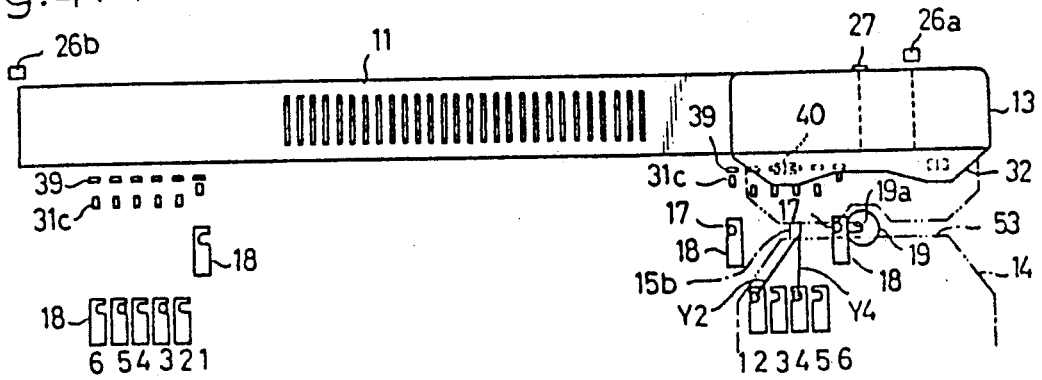
Figure 4:
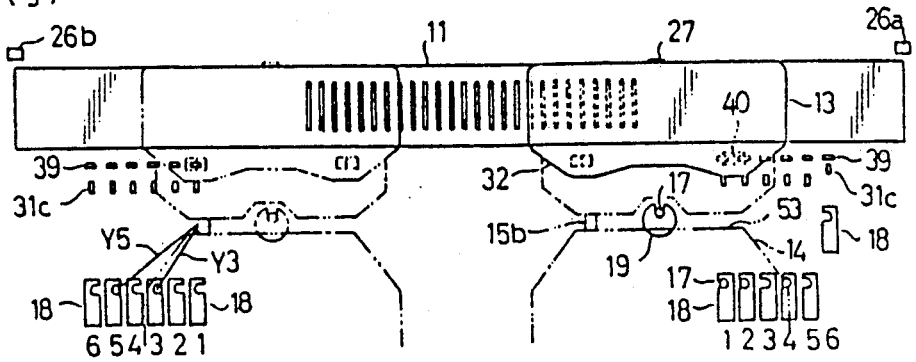
Figure 4:
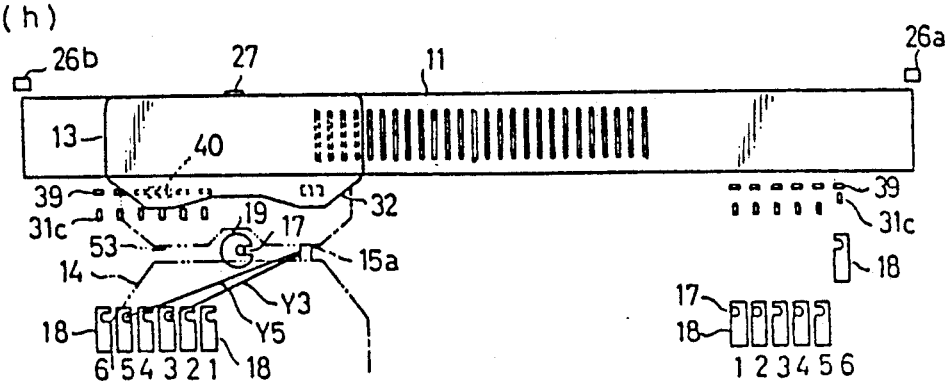
Figure 4:
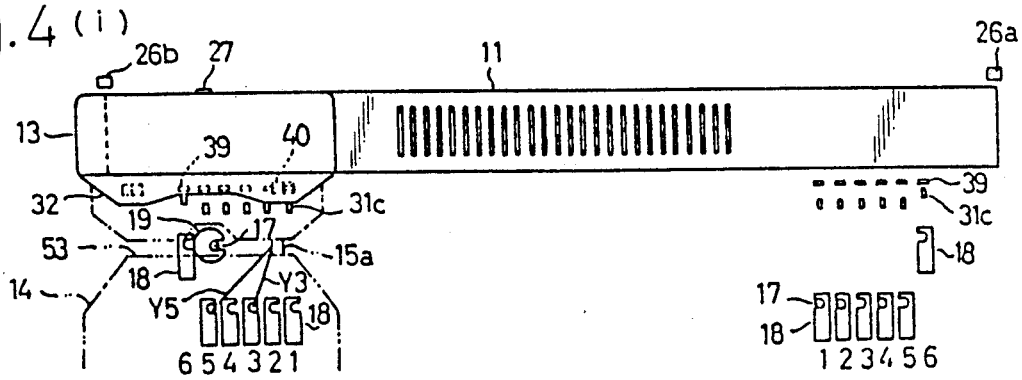
Figure 4:
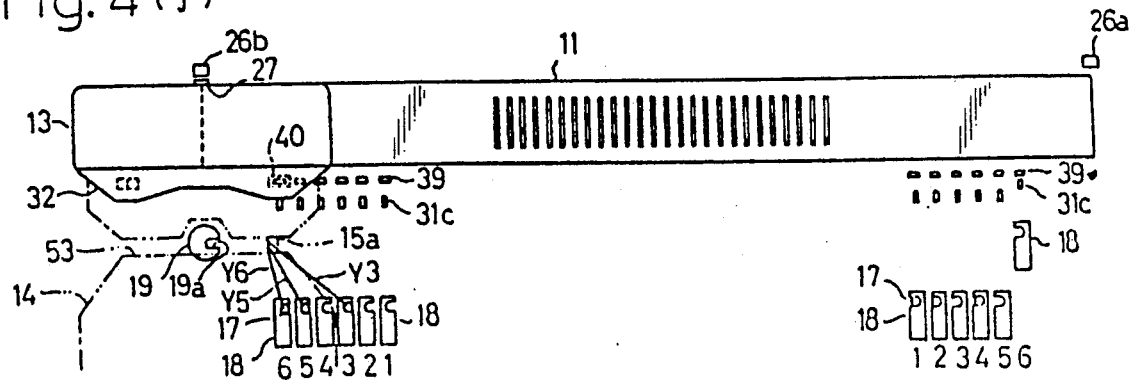

Reference is next made to FIGS. 4*f* and 4*g*. The holder corresponding to the selected yarn is then rotated to the active position. In the example described this is holder #6 in the right support rack 16*a*. The carriages are moved to the left to enable the collar support member 19 to pick the selected yarn for use. The inactive holder #1 is also returned to its withdrawn position. Once the yarn changing device 19*b* clears the support rack, the collar support member is rotated 90 degrees in a clockwise direction so that it assumes the operational position. As before, the selected yarn may be supplied to the needles necessary to knit the desired pattern. If during the movements of the carriage, the connecting member 15*b* comes into contact with the yarns held within the left support rack, they are merely bent out of the way by the left connecting member 15*b*.

When the kniting actions required by the yarn Y6 have been completed, it is replaced in the same manner as described above. It should be appreciated that the exchange can occur at either end of the needle bed, depending upon the actual location of the selected yarn. When all knitting operations are completed, the active yarn is placed in the support rack from which the original yarn was taken.

In the example above, if no further yarn changes were required, the active yarn collar #6 would be placed in the left support rack 16*b*. To accomplish this, the carriages are moved to the left side of the needle array. FIG. 4*g*. Left connecting member 15*b* is withdrawn, while right connecting member 15 is moved into its engagement position. This allows the yarns Y3 and Y5 to enter the passage 53 between carriages 13 and 14. Since yarn Y6 is held by the collar support member, it is also within the passage 53. The collar support member 19 is also rotated 90 degrees in the clockwise direction to its left transfer position as the carriages moves towards the left support rack 16*b*. FIG. 4*h*. Holder #6 in the left support rack is moved to its transfer position and receives the collar that hold yarn Y6 as the yarn changing device 19*b* passes thereby. FIG. 4*i*. Finally, the carriages are parked on the left side of the left support rack as seen in FIG. 4*j* and holder #6 is withdrawn to its holding position. In this arrangement, magnet 27 is aligned with left position sensor 26*b*. If further knitting operations are desired, the carriage would pick the next desired yarn as previously described.

It is noted that the yarns will often cross during the collar exchange. However, since the various yarns are staggered front to back by the yarn guides 21*c*, they do not become entangled.

Figure 5:
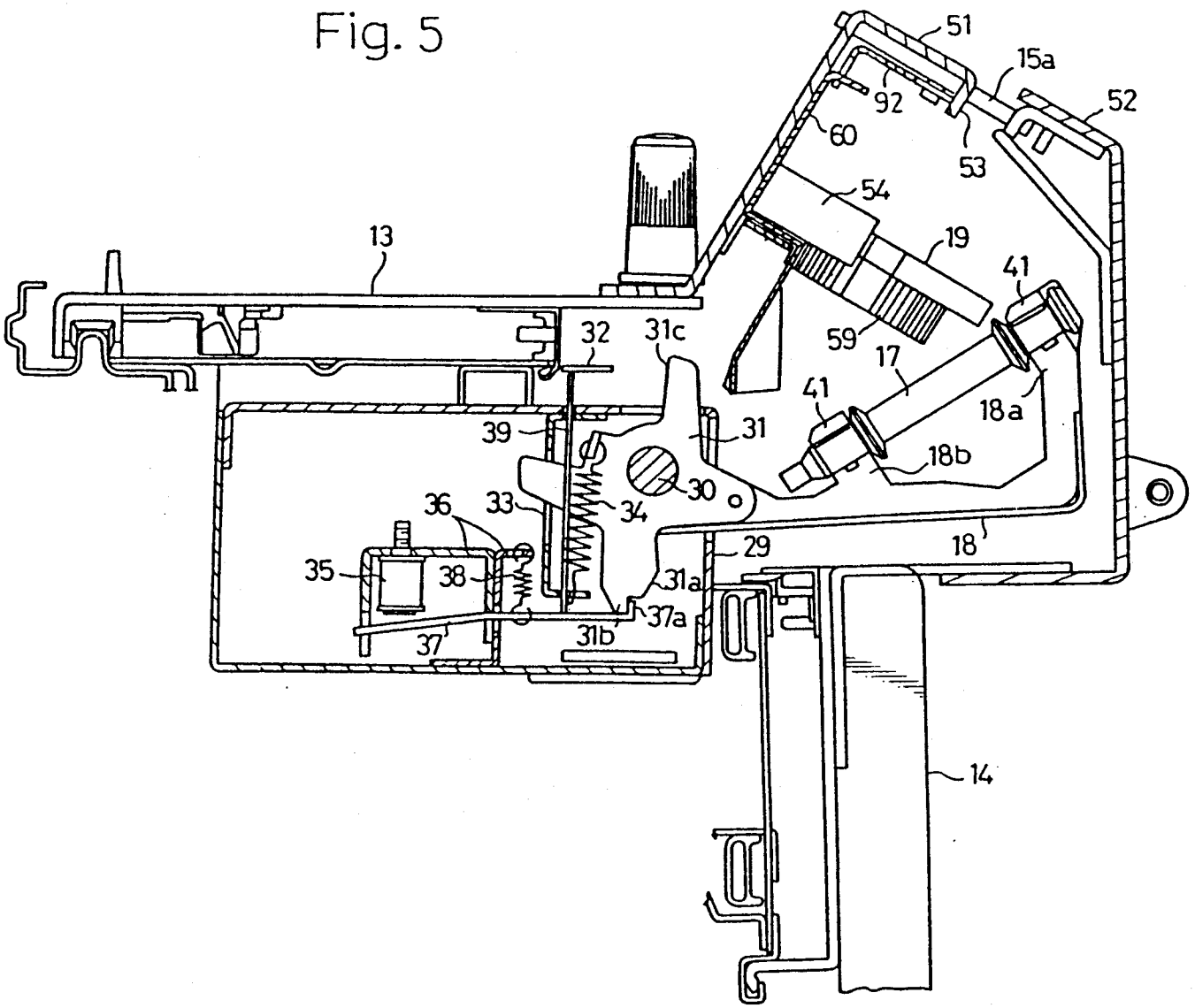
FIG. 5 is a sectional side view of a collar rack for the knitting machine shown in FIG. 3, with its switch lever located in its holding position.
Figure 6:
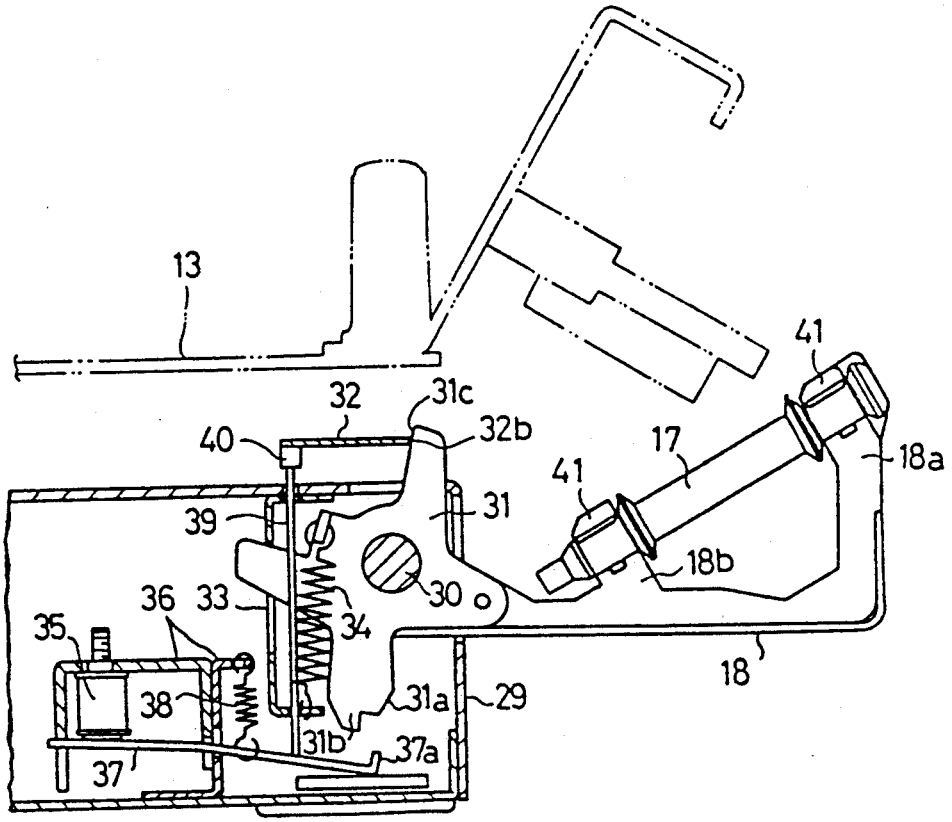
FIG. 6 is a sectional side view of the collar rack shown in FIG. 5 with the switch lever located in its release position.
Figure 7:
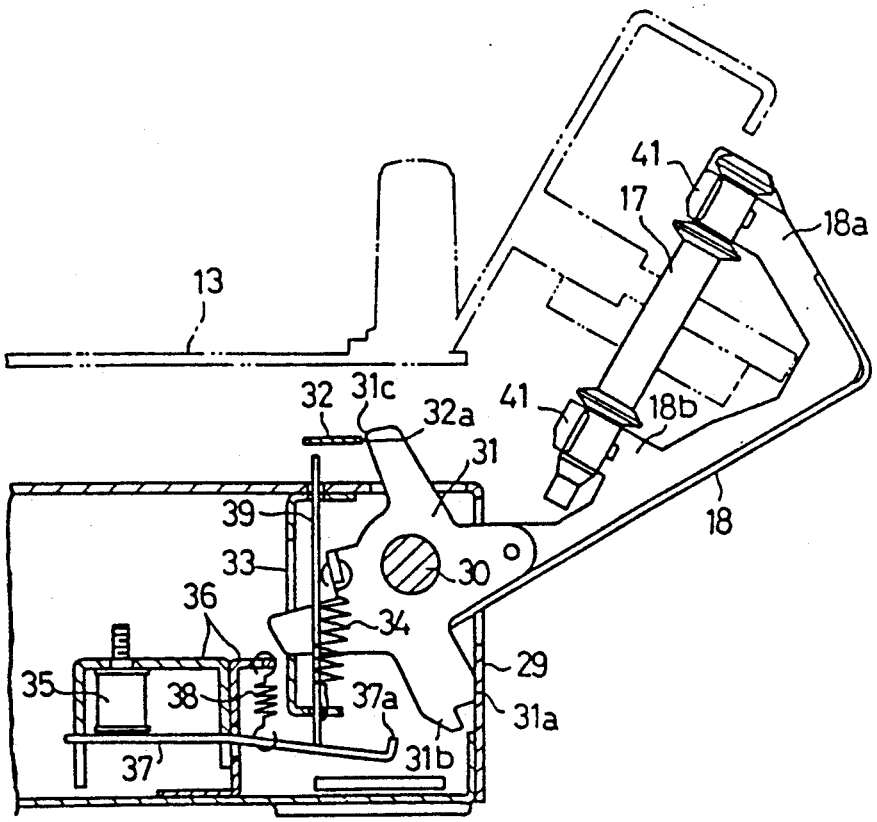
FIG. 7 is a sectional side view of the collar rack shown in FIG. 5 with the collar holder in its transfer position.

Referring next to FIGS. 5–7, the construction of the collar support racks 16 will be described. Since the collar support racks are substantially identical in construction structural details of only one will be described. The collar support rack 16*a* has a frame body 29. Shaft 30, support arm 33 and support member 36 are all mounted to the frame body 29. The shaft 30 is arranged such that its axis lies in parallel with the needle bed 11. A plurality of turn members 31 are independently rotatably mounted on the shaft. One turn member 31 is provided for each collar holder 18. Thus, in the described embodiment, six turn members 31 are provided in each support rack 16. Since the turn members and their associated mechanisms are identical in structure, the construction of only one will be described.

Figure 8:
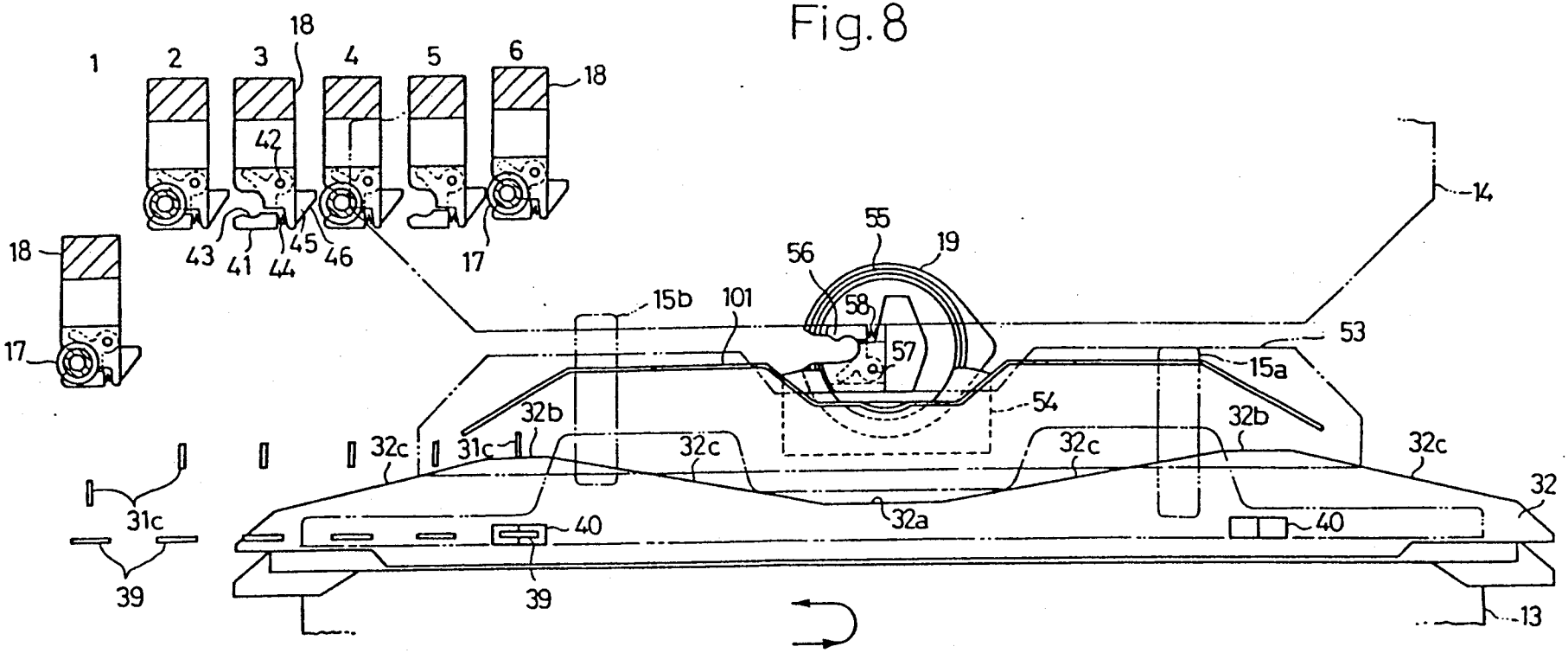
FIG. 8 is a diagrammatic bottom view of the carriage of the knitting machine shown in FIG. 1 in the right transfer position as it initially contacts the right collar rack.
Figure 9:
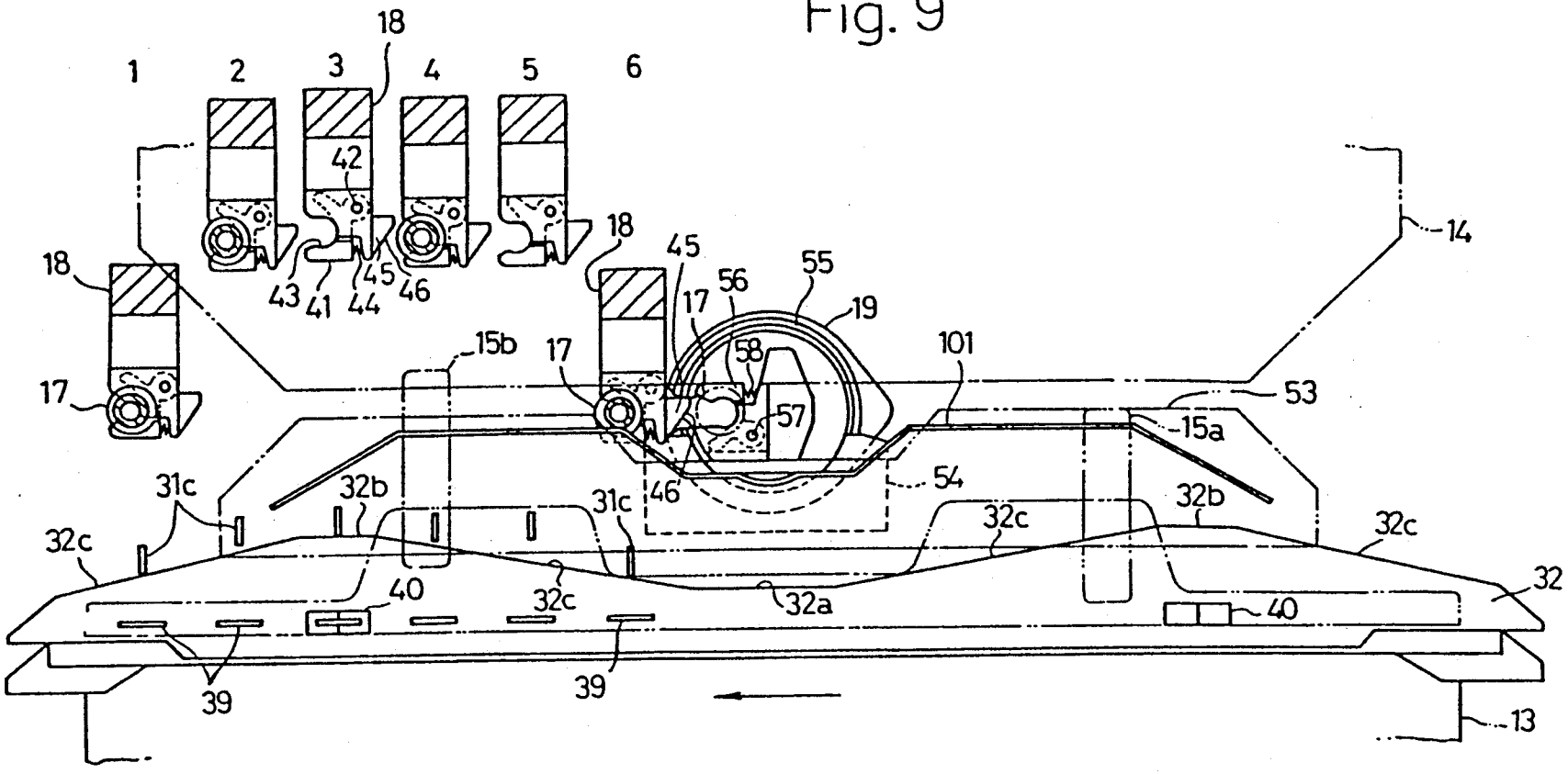
FIG. 9 is a diagrammatic bottom view of the carriage shown in FIG. 8 after it has progressed further into the right collar rack.

As best seen in FIGS. 5–7, each of the turn members 31 has four arms extending radially outward about its periphery. One of the arms carries the turn member's associated collar holder 18. A second arm has a tapered contact surface 31*a* and a finger 31*b*. A third arm 31*c* acts as a contact against cam member 32 carried by the carriage 13 as best seen in FIGS. 8 and 9. The contact surface 31*a* is arranged to rest against the frame 29 when the collar holder 18 is in its transfer position. Thus, in effect, the turn member 31 acts as a stop for positively positioning the collar holder 18 in the transfer position. The finger 31*b* cooperates with a selectively actuatable switch lever 37 to hold the collar holder in the withdrawn position during normal operation of the knitting machine.

A biasing spring 34 is connected between the periphery of turn member 31 and the fixed support arm 33 in order to urge the turn member 31 (and thus the collar holder 18) towards the transfer position. The biasing spring 34 is sized such that absent competing forces, it will rotate the turn member and collar holder into the transfer position.

The contact arm 31*c* is arranged to engage the surface of a camming member 32 carried by the carriage 13. Thus, when the carriage passes a selected holder, the turn member 31 will pivot about the support shaft 30 under the influence of the camming member 32. The shape of camming member 32 is best seen in FIGS. 8 and 9. The camming member 32 is symmetrical about a central valley portion 32*a* that is positioned opposite the collar support member 19. It also has a pair of spaced apart top surfaces 32*b* and inclined guide surfaces 32*c* that slope downward from both sides of each top surface 32*b*. The centrally located inclined guide surfaces lead to the central valley portion 32*a*. A pair of activating cams 40 are provided on the lower surface of the camming member 32 opposite the respective top surfaces 32*b*.

As indicated above, the actuating mechanisms for the collar holders 18 all have identical constructions. Therefore, the construction of only one will be described in detail. The switch lever 37 is loosely carried by support 36 and cooperates with a selectively actuatable electromagnet 35 and a biasing spring 38 to selectively move between release and holding positions. The switch lever 37 has a substantially horizontal orientation although it has a slight bend near its center and an upturned lip 37*a* that cooperates with finger 31*b* on the turn member 31. A vertically extending riser 39 cooperates with the switch lever 37 and extends upwardly through openings in the support arm 33 and frame 29. The biasing spring 38 is connected between the support 36 and switch lever 37 to urge the front side of the switch lever (i.e. the right side as viewed in FIGS. 5–7) upward to a holding position wherein the lip 37*a* engages the finger 31*b* on turn member 31 in order to maintain the collar holder 18 is its withdrawn position as seen in FIG. 5. Thus, when the switch lever 37 is in the holding position, it overcomes the forces of spring 34 to maintain the collar holder 18 in the withdrawn position.

The activating cams 40 on camming member 32 are arranged to cooperate with risers 39 in order to release the turn member 31 from switch lever 37. Referring specifically to FIGS. 6 and 9, the riser 39 extends well outside the frame 29 in order to cooperate with the activating cam 40. When an activating cam 40 passes over the riser 39, it forces the riser 39 and thus switch lever 37 downward to a release position free from turn member 31. However, at this point, the turn member does not rotate towards the transfer position because the top portion 32*b* of camming member 32 is pressing against contact arm 31*c* of the turn member to hold the turn member in place. FIG. 6.

In order to prevent the activating cam 40 from inadvertently releasing all of the collar holders 18 as it passes, the top portion 32*b* of camming member 32 and the activating cam 40 are sized such that the activating cam will release riser 39 before camming member 32 allows the turn member 31 to rotate sufficiently to stay clear of lip 37*a*. That is, if the particular collar holder 18 being passed by the cam 40 is not to be activated, as activating cam 40 passes, spring 38 lifts the switch lever 37 and riser 39 sufficiently such that lip 37*a* reengages finger 31*a* on turn member 31. In such circumstances, the holding position shown in FIG. 5 is resumed.

If, on the other hand, the associated collar holder is to be lifted to the transfer position, the electromagnet 35 is activated lifting the back side of the switch lever 37 (the left side as shown in FIG. 7). This maintains the switch lever in the position shown in FIG. 7, wherein the electromagnet and an opening in support 36 (through which the switch lever passes) cooperate to hold the lip end 37*a* of the switch lever 37 down low enough such that the finger 31*a* of turn member 31 passes thereover as the inclined surface 32*c* slides across contact arm 31*a* allows the turn member 31 to rotate into the transfer position. It is noted that spring 34 is sized large enough so that absent a restraining force from either camming member 32 or switch lever 37, the spring will rotate the turn member 31 into the transfer position.

If a transfer is to be made between the holder 18 and the collar support member 19, the inclined surface 32*c* allows the holder 18 to gently rotate into the transfer position. The transfer position is firmly established by the valley 32*a* which is positioned directly across from the collar support member. Thus anytime the collar support member passes a holder that is not in its withdrawn position, it will necessarily assume the transfer position due to the influence of the valley portion 32*a* of camming member 32. In the transfer positions, transfers from the holder to the collar support member and vice versa may both occur.

When it is desired to return the holder 18 to the withdrawn position, the electromagnet 35 is merely turned off. This releases the back side of switch lever 37 allowing the spring 38 to return the switch lever to its holding position. The next time the carriage passes by the selected collar holder 18, the camming member 32 forces the turn member to rotate back to the withdrawn position and it is again captured by the switch lever 37 as discussed above.

The structure of the holder 18 will next be described referring to FIGS. 5 and 8. The holder 18 has an elongated base member that is firmly attached to one of the arms of turn member 31. Two support arms 18*a* and 18*b* extend outward from the base. The upper support arm 18*a* is substantially longer than lower support arm 18*b* in order to present the collar 17 held therein to the collar support member 19 in the desired orientation as shown in FIG. 7. Each of the support arms 18*a* and 18*b* have a resilient clamping arrangement that includes a clamping finger 41 that is pivotally coupled to the support arm by a pivot 42. A rounded opening 43 sized to receive a collar is formed by the surface of the support arm and the clamping finger 41. The opening 43 is somewhat C-shaped to firmly grasp a collar positioned therein. A spring 44 biases the finger to assume the C-shaped position shown in FIG. 8. However, during the actual transfer operation the finger can be deflected somewhat in a pivoting manner to facilitate the transfer. The strength of the spring is chosen such that it will readily allow the transfer to occur yet will firmly hold the collars in place absent an influence from the collar support member.

Figure 11:
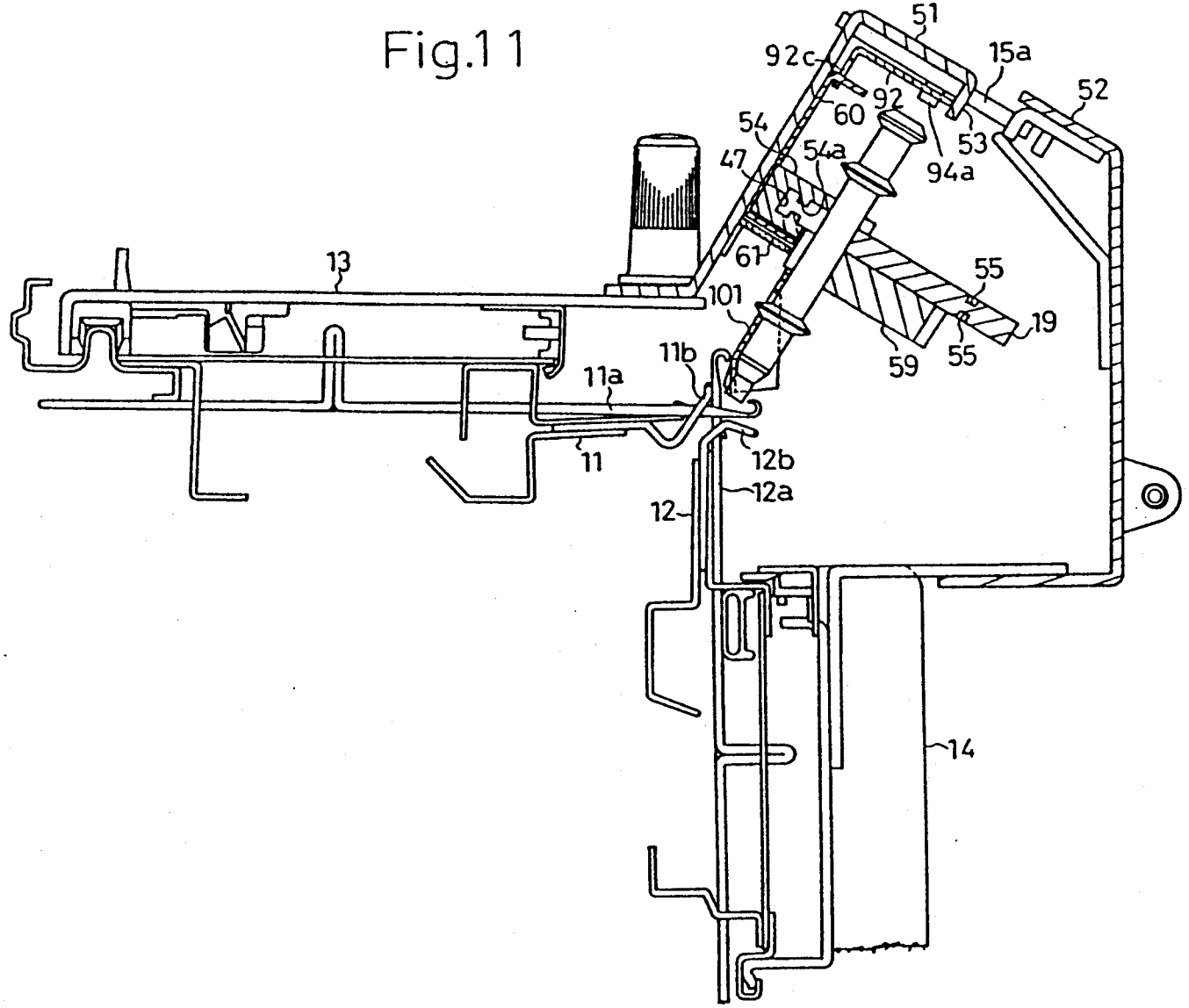
FIG. 11 is a cross-sectional side view of the carriages and the carriage connection device.

The collar support member 19 has a similar clamping structure as well. Specifically, as also seen in FIG. 8, a clamping finger 56 is pivotally coupled to the collar support member 19 by pivot 57. Spring 58 biases the clamping finger to its closed (retaining) position. Referring next to FIGS. 10 and 11, a latch stop board 101 carried by frame 51 extends below the support member 19 to prevent the latches for the hooks on needles 11*a* and 12*a* from closing during the knitting operation. The latch stop board has an indented center portion which serves as a rest for the lower portion of the collar 17 held by the collar support member 19. Thus, the latch stop board positions the collar head between the hooked portions of needles 11*a* and 12*a* as seen in FIG. 11.

The construction of the yarn changing device 19*b* will be described next. Reference is initially made to FIGS. 1, 2 and 11. Each of the carriages 13 and 14 has a frame, 51 and 52 respectively, mounted thereto. A pair of slide grooves 62 are provided in the frame 51. The slide grooves mirror one another with each groove 62 having a pair of offset elongated straight segments 62*a* and 62*b*, a connecting segment 62*c* that couples the elongated segments and a runout segment 62*d*.

A control plate 60 is slidably mounted to frame 51. The control plate 60 has a toothed rack 61 formed on its bottom surface and a pair of matching followers 63 mounted its opposite sides. Each follower 63 is pivotally mounted to the control plate 60 by pivot 64 and includes an arcuate slot 66 and a nub 63*a* on its front surface. The follower 63 also has a roller 67 that is constrained to movement within both the slide groove 62 on frame 51 and the arcuate slot 66. Thus, as the control plate 60 moves relative to the frame 51, the movements of the follower 63 are dictated by the geometry of the slide groove 62. A bias spring 65 is wound about the pivot 64 and its opposite ends are held by nub 63*a* and a fixed projection 60*b* on control plate 60. Thus, the bias spring 65 always urges the follower member downward as shown FIG. 1*b*.

A contact finger 68 is pivotally coupled to the follower by a pivot 69. Its movements in one direction are constrained by a stop 63*b* which protrudes outward from the front surface of the follower 63. A spring 70 is wrapped around the pivot 69 and its opposite ends are held by a nub 68*a* on contact finger 68 and the pivot 64 on the follower. As can best be seen in FIG. 1*b*, the spring 70 is set so that the contact finger 68 presses against the stop 63*b* and assumes a substantially vertical position when it is unaffected by other parts. In this position the tip of the contact finger extends somewhat below both the follower and the control plate.

The collar support 19 is coupled to the frame 51 by support member 54. As best seen in FIG. 11, the collar support 19 is received within a relatively large support chamber 47 in the support member 54. The collar support has a pair of annular guiding grooves 55 which cooperate with teeth 54*a* on support member 54 to firmly secure the collar support 19 to the frame while allowing it to rotate within the support chamber 47.

A pinion gear 59 is mounted to the lower surface of the follower 19. The pinion gear 59 meshes with the rack 61 carried by the control plate 60. Thus, movements of the control plate 60 relative to the frame 51 translate to rotations of the collar support 19. The yarn changing device is arranged such that in operation, when the carriages move outside of the knitting needle arrays 11*c*, 12*c* on the needle beds, the contact finger 68 engages a block 96 which loosely holds it in place as the frame 51 continues to move further outside the needle array. These movements induce as 90 degree rotation of collar support 19. Once the collar support has been rotated 90 degrees a stopping arrangement causes the control plate to reengage the frame so as that any continued movements away from the needle array are in unison.

It is noted that blocks 96 are provided on both sides of the needle bed and are positioned such that they move the control plate relative to the frame between the needle arrays and the respective collar racks 16. Thus, as mentioned above, the collar support member 19 is rotated before it is aligned with a collar rack 16. In the regions opposite the collar racks, the frame 51 and the control plate 60 travel together.

The relative movements of control plate components of the will next be described. In the operational position, as shown in FIG. 1, the collar support member 19 is centered relative to the control plate 60. In the embodiment shown in FIG. 2, the carriages have moved to the right of the needle beds and the intended rotation of the collar support member 19 has just been completed. In the operational position, the rollers 67 carried by the opposing followers 63 rest at the junctions between the outer straight segments 62*b* and the joining sections 62*c* of their respective slide grooves 62 as seen in FIG. 1.

When the carriage is moved to the right beyond the needle array, the right side contact finger 68 strikes block 96. The stop 63*b* prevents the contact finger from rotating relative to the follower 63. Since both followers 63 are constrained to move only in accordance with the path of slide groove 62, the control plate 60 remains substantially in place while the carriage 13 and its frame 51 continue to move to the right (to the position seen in FIG. 2). Thus, the roller 67 carried by the left hand follower moves along the outer straight segment 62*b* of its associated left slide groove. In contrast, the roller 67 associated with the right hand follower passes along the inner straight segment 62*a* of its associated slide groove. The relative motion of the control plate and the frame stops at the end of the straight segments. Thus, since the purpose of the relative motion is to rotate the support collar 19 by 90 degrees, the length of the straight segments 62*a* and 62*b* are determined by the rack range required to rotate the pinon gear 59 by 90 degrees.

Once the right hand roller 67 has reached the end of the inner straight segment 62*a*, it slides upward along runout 62*d*. This causes both its associated follower 63 and connecting finger 68 to rotate about pivot 64. The runout 62*d*, the contact finger 68 and block 96 are all sized and arranged such that when the roller 67 rotates into runout 62*d*, the contact finger 68 will rotate enough so that it will pass over block 96. As such, the entire carriage may continue past the collar rack 16 as previously described. When the opposing (i.e. left hand) contact finger comes into contact with the control block, it will rotate about pivot 69 against the force of spring 70 (to the position shown by the dashed line in FIG. 2*b*) such that it will also glide over the block 69.

After the desired collar exchange has been completed, the carriage is moved back towards the needle array. Once the contact finger 68 slides off of the block 96, the spring 70 returns it to the upright position against stop 63*b*.

To return the control plate 60 to the operational position, a pair of push rods 82 and 83 are coupled to the frame. A pair of spaced apart support pieces 81*a* and 81*b* are secured to a non-rotating portion of the yarn changing device. Each push rod passes freely through the opposing support pieces, which serve as guides. A washer 82*a*, 83*a* is secured to each push rod to anchor an associated coil spring 84, 85. The coil springs 84 and 85 are journaled about their associated push rod between an associated washer and one of the support pieces. The various components are arranged such that in the operational position, the washers 82*a* and 83*a* are positioned adjacent opposite support pieces as the free ends of their associated springs. One end of each push rod extends into a position adjacent pad 60*c* on the control plate 60. See FIG. 1.

When the control plate 60 translates relative to the frame 51, one of the pads will press against its associated push rod. In the situation shown in FIG. 2, the right pad 60*c* presses against the push rod 82. Thus, as the frame 51 translates to the right relative to the control plate 60, push rod 82 is pushed to the left relative to the support pieces causing washer 82*a* to compress its associated spring 84. When the control plate is free from the influence of the block 96, the compressed spring 84 provides the restoring force to return the control plate to the operational position. Push rod 83 and spring 85 cooperate to produce the same restoring force when the frame translates to the left relative to the control plate.

Figure 12:
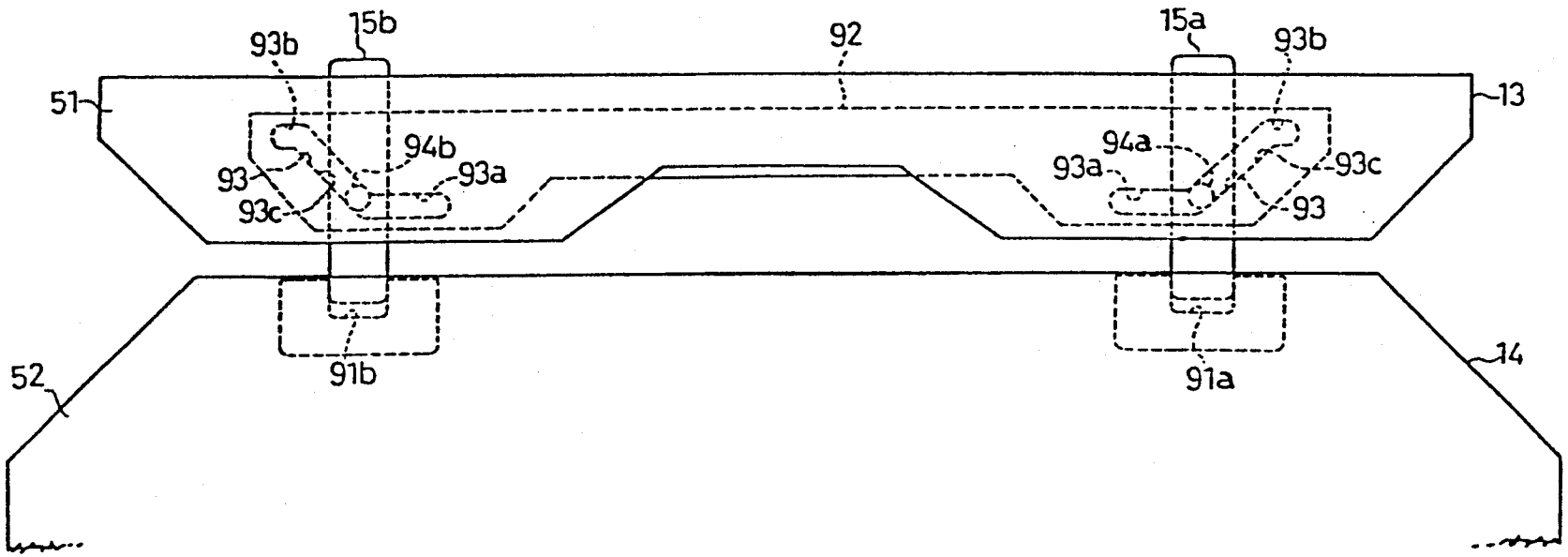
FIG. 12 is a top plan view of the carriage highlighting the carriage connectors and their supports.

The actuation of the connecting members 15 will be described next. As indicated above, the connecting members cooperate such that one of the connecting members always couples the carriages 13 and 14 together. Referring primarily to FIG. 12, the connecting member 15*a* (15*b*) is carried by the carriage 13 and has a plug 94*a* (94*b*) extending slightly upward from its top surface. The plug is received within an associated guide groove 93 in the frame 51. The guide grooves 93 are mirror images of one another and each includes a pair of offset, horizontally extending segments 93*a* and 93*b*, as well as an inclined segment 93*c* which joins the offset segments. The horizontally extending segments 93*a* located to the front of the carriage 13 are substantially longer than the rear segments 93*b*. As can be readily seen in FIG. 12, when a plug 94*a* (94*b*) is located within the front segment 93*a*, then the associated connecting member 15*a* (15*b*) is fully extended such that it engages the latch 91*a* (91*b*) on carriage 14. In contrast, when the plug 94*a* (94*b*) is in a rear segment 93*b* of the guide groove, the guide member 15*a* (15*b*) is withdrawn from its associated latch 91*a* (91*b*).

In order to egress and withdraw the connecting members, a sliding plate 92 is coupled to the frame 51 such that it may slide side to side by a short amount. Movements of the sliding plate 92 are driven by control plate 60. However, the sliding plate is not fixed to the control plate. Rather, a slot 60*d* is provided in the upper edge of the control plate and a rigid finger 92*c* extends downward from the sliding plate 92 into the slot 60*d*. The length of slot 60*d* is less than the range of the control plates motion. Thus, the sliding plate will move less than the control plate. Accordingly, the connecting members are only switched while the collar support member is being rotated.

To prevent the sliding plate 92 from slipping during operation, a pair of positioning holes 92*a* and 92*b* are provided on the surface of the sliding plate. A leaf spring 90 is provided that has a rounded tip that is arranged to engage the positioning holes. When connecting member 15*a* is fully extended and connecting member 15*b* is fully retracted, the rounded portion of the leaf spring is pressed into positioning hole 92*b*. In contrast, when connecting member 15*b* is fully extended and connecting member 15*a* is fully retracted, the leaf spring is pressed into positioning hole 92*a*. Thus, the resilient forces of the leaf spring 90 and the positioning holes cooperate to hold the sliding plate 92 in place during movements of the carriages apart from the regions wherein the connecting members are switched. However, since leaf spring 90 is resilient, when the rigid finger 92*c* is pushed by control plate 60, then the leaf spring readily pops out of its positioning hole and slides across the surface of the sliding plate as the sliding plate passes thereby. When the connecting members have been fully exchanged, the leaf spring will slide into the opposite positioning hole.

As can be seen in FIG. 12, the relative lengths of the various segments of the guide grooves 93 are chosen such that at least one of the connecting members 15*a* and 15*b* will always couple the carriages 13 and 14. Thus the plugs 94*a* and 94*b*, when traveling in opposite directions will both reach the junction between the elongated front segment 93*a* and the inclined segment 93*c* at substantially the same time.

It is also desirable to provide mechanisms for insuring that damage to the knitting machine is avoided when there is an inadvertent collision between a collar and a mechanism for holding the collars. Referring initially to FIG. 1*a*, a triangular deflection plate 71 is rotatably coupled to a pivot 72 on the back side of the collar support member 19 opposite the recess 19*a*. The deflection plate has a pair of deflection surfaces 73 and 74 formed on its leading edges. The back side of the deflection plate is curved somewhat and slides over a sliding surface on a fixed projection 76 of the collar support member. A spring 75 is coupled between the collar support and the deflection plate to bias the deflection plate to the neutral position shown in FIG. 1*a*.

Figure 2A:
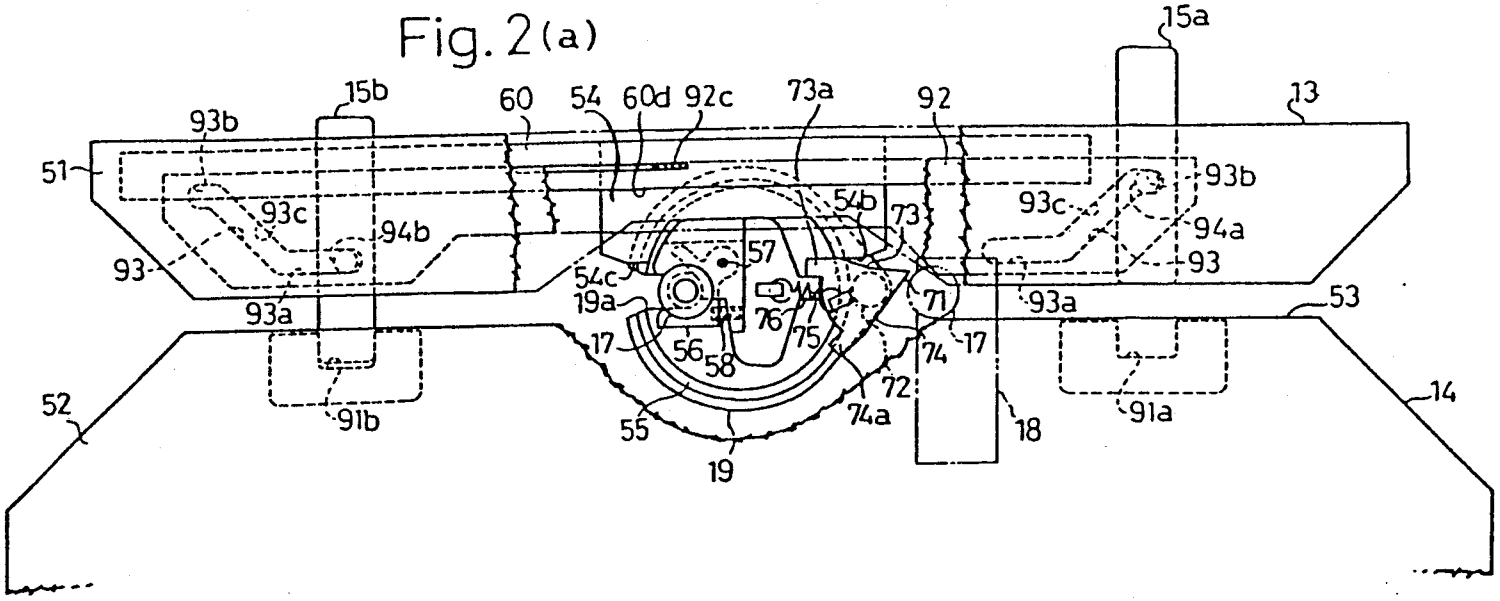
FIG. 2(*a*) is a top plan view of the carriage connecting device shown in FIG. 1(*a*) with the collar support member oriented in its right transfer position.
Figure 2B:
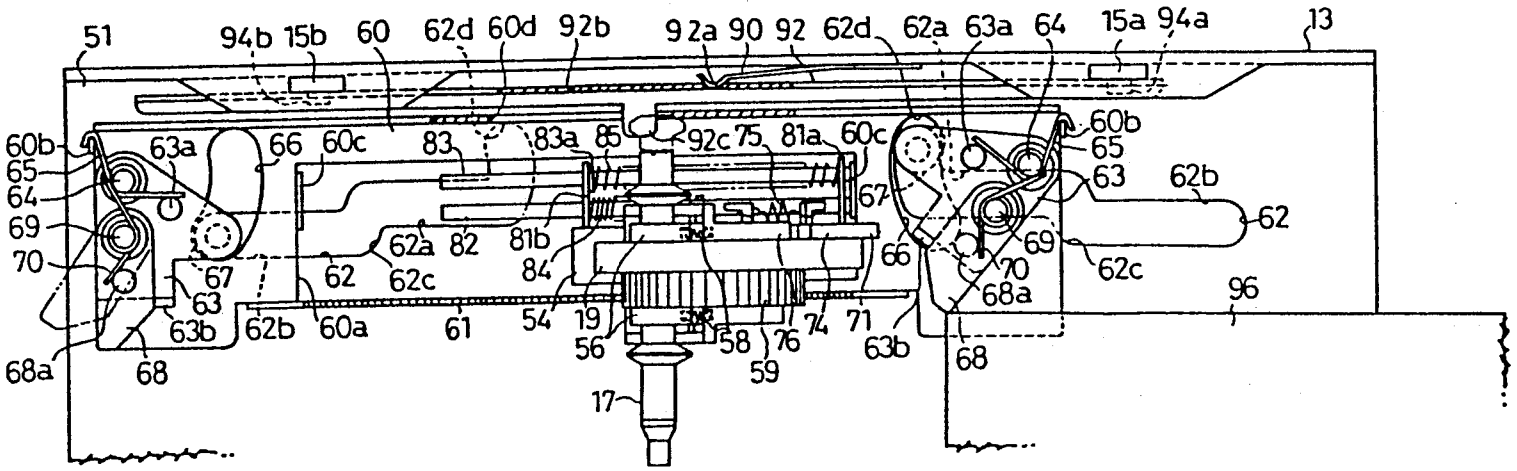

Reference is next made to FIG. 2*a*. The support member 54 is symmetrical about the collar support member 19 and has shoulders 54*b* and 54*c* formed on its leading edges. When the collar support member 19 is rotated to the right (left) transfer position, a contact surface 73*a* (74*a*) of the deflection plate 71 engages shoulder 54*b* (54*c*) to rotate the deflection plate into a deflecting position with the deflecting surface 74 (73) facing opposite the recess 19*a*. The motion of the deflection plate is limited by flanges on the back surfaces of the deflection plate which cooperate with the projection 76.

With this orientation, the deflection plate extends into yarn passage 53 to protect against collisions with any collar holders 18 which may already have a collar therein. As seen in FIG. 2*a*, if it is assumed that a holder 18 holding a collar therein is inadvertently positioned in the transfer position as marked by the two dashed broken line, it would contact the deflection surface 74 as shown. The deflection surface would then brush the holder towards its withdrawn position on the proper side of the yarn changing device 19*b* thereby avoiding a potentially damaging collision.

When the collar support member 19 is rotated back to the operational position, the biasing spring 75 returns the deflection plate to the neutral position.

Referring next to FIG. 8, a similar mechanism is provided for protecting against collisions in the opposite direction. Specifically each of the holders 18 has a deflecting pad 45 mounted to the back side of its lower arm 18*b*. The deflecting pad 45 has an inclined surface 46 facing away from the fingers 41 which grip the collar 17. In the event that the yarn changing device is carrying a collar as it approaches a holder 18 with the recess facing in the direction of movement, then the collar would strike the inclined surface 46 of the deflecting pad 45 brushing it aside to prevent damage. Since the deflecting pad 45 is mounted on the lower grip, it deflects the holder 18 in a manner which readily causes rotation about the shaft 30 as opposed to twisting the holder.

Although only one embodiment of the present invention has been described in detail herein, it should be apparent to those skilled in the art that the present invention may be embodied in many other specific forms without departing from the spirit or scope of the invention. Particularly, it should be understood that the invention is not limited to the specific designs described for the support rack, and the yarn changing device. Additionally, the knitting machine could easily be adapted to utilize more different yarns although obviously there is some upper limit to this. Therefore, the present examples and embodiments are to be considered illustrative and not restrictive and the invention is not to be limited to the details given herein, but may be modified within the scope of the appended claims.

What is claimed is:

1. A flat bed knitting machine comprising:

a longitudinally elongated needle bed having a knitting section for holding a multiplicity of needles, the needle bed having first and second sides;

a plurality of yarn guide collars each adapted to hold a yarn;

a carriage slidably mounted on the needle bed for longitudinal movement relative to the needle bed;

a pair of collar support racks for detachably holding a plurality of said collars, the collar support racks being disposed on opposite sides of the knitting section; and collar support means carried by the carriage for detachably holding a selected one of said collars, the collar support means having first and second transfer positions, wherein a selected collar may be exchanged between said collar support means and a first one of said collar support racks in the first transfer position and the selected collar may be exchanged between the collar support means and a second one of said collar support racks in the second transfer position.

2. A knitting machine as recited in claim 1 further comprising position changing means for changing the position of said collar support means in response to movements of said carriage relative to the needle bed, the position changing means being carried by the carriage.

3. A knitting machine as recited in claim 2, wherein said collar support means further has an operational position at which knitting may occur, the operational position being distinct from said transfer position and wherein said position changing means includes:

a control plate coupled to said carriage for movement relative to the carriage within a predetermined range wherein the control plate interlocks with said carriage when said carriage moves within the knitting section and moves relative to the carriage in predetermined regions between said knitting section and said collar support racks; and transfer means for transferring the movement of said control plate to said collar support means to change the position of said collar support member.

4. A knitting machine as recited in claim 3 further comprising:

an activation block disposed between said knitting section and said collar support racks for initiating movement of the control plate;

a follower pivotally mounted to the control plate and cooperating with the carriage to limit the control plates range of motion of the control plate relative to the carriage; and a contact finger carried by the follower for engaging said activation block, wherein when the contact finger initially strikes the activation block while moving in a first direction the contact finger cooperates with the follower to move the control plate relative to the carriage and wherein when the contact finger initially strikes the activation block while moving in a second direction, the contact finger does not effect movement of the follower.

5. A knitting machine according to claim 2, wherein said collar support means further has an operational position at which knitting may occur and wherein said collar support means includes:

a collar support member rotatably supported by the carriage for rotation about an axis;

a collar holding mechanism including a recess in said collar support member for holding the selected yarn guide collar at an eccentric position relative to the rotational axis of said collar support member; and wherein in said operational position, the collar holding mechanism faces a fabric to be knitted and in the transfer positions the collar holding mechanism faces the opposite side of the needle bed as the collar support rack to which a transfer is to be made.

6. A knitting machine according to claim 5, wherein said collar support member is substantially annular and the collar support means further includes a support structure carried by the carriage and having a recess therein that is adapted to carry the collar support member by engaging the outer periphery of the collar support member.

* * * * *